United States Patent [19]

Wachs et al.

[11] 4,318,391

[45] Mar. 9, 1982

[54] PILE-CUTTING MACHINE AND METHOD OF CUTTING MULTI-SIDED PILES

[75] Inventors: Edward H. Wachs, Lake Forest; Horst Kwech, Gurnee, both of Ill.

[73] Assignee: The E. H. Wachs Company, Wheeling, Ill.

[21] Appl. No.: 155,602

[22] Filed: Jun. 2, 1980

[51] Int. Cl.[3] ..... B28D 1/04

[52] U.S. Cl. ..... 125/14; 51/283 R

[58] Field of Search ..... 125/13 R, 13 SS, 14; 51/283 R

[56] References Cited

U.S. PATENT DOCUMENTS

| | | | |
|---|---|---|---|
| 3,688,615 | 9/1972 | Protze | 125/14 |
| 4,144,867 | 3/1979 | Wachs | 125/14 |
| 4,180,047 | 12/1979 | Bertelson | 125/14 |
| 4,233,954 | 11/1980 | Vizzer | 125/14 |

FOREIGN PATENT DOCUMENTS

| | | | |
|---|---|---|---|
| 264993 | 11/1970 | U.S.S.R. | 125/14 |

*Primary Examiner*—Harold D. Whitehead

*Attorney, Agent, or Firm*—Wegner, Stellman, McCord, Wood & Dalton

[57] ABSTRACT

A pile-cutting machine for cutting multi-sided piles, such as square piles, having a frame which can be clamped to the pile at a desired location, a carriage mounted on the frame for movement in a continuous path around the pile and a cutting head carried by the carriage with a power-driven cutter positioned relative to the carriage to be at full cutting depth in a pile as the carriage moves along a straight side of the pile and, thereafter, to automatically withdraw from the pile as the carriage swings in travelling around a corner of the pile and subsequently move to full cutting depth in the pile as the carriage advances along the next straight side of the pile.

16 Claims, 7 Drawing Figures

71
72
73
58
90
12
20
79
77
74
78
61
70
85
79a
80
67
15
82
30
60
76
100
P
79a
81
57
55
56
59
50
4.
21
23
35
20
10
24
18
22
86

15
30
55
56
57
62
59
35
67
80
76
79a
5.
80a
73
75
37
C
65
39
71
72
74
50
76a
66
68
69
36
79a
58
90
92
P
80a
87
70
83
96
95
82
81
86
85
84

PILE-CUTTING MACHINE AND METHOD OF CUTTING MULTI-SIDED PILES

BACKGROUND OF THE INVENTION

This invention pertains to a method of cutting a multi-sided pile in a single pass therearound and to a pile-cutting machine which successively advances a power-driven cutter along straight sides of the pile at a cutting depth and which fully withdraws the cutter between cuts along sides of the pile.

After driving of a pile to a desired depth, it is frequently necessary to cut off an upper part of the pile to have the upper end of the pile at a desired level. Concrete piles are in use which are either cylindrical or multi-sided, as having a square cross section. Such piles have metal rods imbedded therein at a distance beneath the surface of the pile and have a central core area free of such rods. In cutting of a square pile, the best operation is to have a power-driven cutter cut through the reinforcing rods and to a desired depth within the pile along each side thereof in a single pass of the cutter. Thereafter, the mounting frame for the cutter can be lifted and, by being clamped to the part of the pile above the cut, the remaining core part of the pile is snapped off and the driven pile then has its upper end at the desired level.

The cutting of concrete piles containing reinforcing rods is known in the art. A machine for cutting cylindrical piles is shown in U.S. Pat. No. 4,144,867, owned by the assignee of this application. The machine has a frame which can be clamped to the pile and a carriage movable along guide means carrying a power-driven cutter which makes a uniform depth of cut in the pile in a traverse of the carriage around the pile.

U.S. Pat. No. 4,180,047 shows a complex machine for cutting a multi-sided pile wherein a series of cutters are repeatedly advanced along the sides of a pile at increasing depths to provide the desired depth of cut in the pile.

The machines of the aforesaid patents are not constructed to have a single cutter automatically cut a multi-sided pile to a uniform depth along all sides thereof in a single pass.

SUMMARY OF THE INVENTION

A primary feature of the invention disclosed herein is to provide a pile-cutting machine for cutting a multi-sided pile, such as a square pile, with a power-driven cutter in a single pass of the cutter around the pile and with the cutter not being subjected to binding forces as the cutter travels around a corner of the pile. The cutter is automatically withdrawn from the cut during the advance thereof at the end of travel along one side of the pile and, thereafter, re-enters the cut as the cutter is advanced along the next side of the pile.

More particularly, the invention pertains to a square pile-cutting machine having a frame positionable at a desired location along the length of, with means for clamping thereof to a square pile, a carriage mounted on the frame for movement in a continuous path around the pile, and a cutting head carried by the carriage with a power-driven cutter positioned relative to the carriage to be at full cutting depth in the pile as the carriage moves along a straight side of the pile and, thereafter, automatically withdraw from the cut in the pile as the carriage travels around a corner of the pile, followed by the cutter advancing back into the cut to full cutting depth as the carriage advances along the next side of the pile.

The machine, as defined in the preceding paragraph, has guide means mounted on the frame and shaped to define a square with rounded corners and intermediate straight sections to have all parts thereof lie at a substantially uniform distance from the surface of the pile. The carriage is guided on the guide means for straight-line movement along the intermediate straight sections of the guide means and for swinging movement around the rounded corners of the guide means and with the power-driven cutter in trailing relation to the carriage at an angle whereby, as the carriage swings, the cutter is moved outwardly from the cut as the cutter approaches the end of a cut along one side of the pile and, thereafter, as the carriage moves along the next straight section of the guide means, the cutter is advanced back into the pre-existing cut to move at full depth for cutting along the next side of the pile.

Additional features of the invention pertain to the construction of the pile-cutting machine providing for adjustability in the depth of cut in the pile, means for advancing and retracting the power-driven cutter relative to the full depth cutting position, and a continuous gear track mounted to the frame of the machine having the same general shape as said guide means and coacting with a driven gear on the carriage in mesh therewith for propelling the carriage along the guide means.

Another feature of the invention is to provide a method of cutting a multi-sided pile by a rotatable cutter in a single pass of the cutter around the pile comprising, rotating the cutter at a cutting speed, feeding the cutter into the pile to a cutting depth, advancing the cutter along the side of the pile to form a straight length of cut in said pile, positioning the cutter for advance along the next side of the pile while simultaneously withdrawing the cutter from the preceding length of cut, and repeating said positioning and withdrawal until all sides of the pile are cut.

DESCRIPTION OF THE PREFERRED EMBODIMENT

Figure 1:
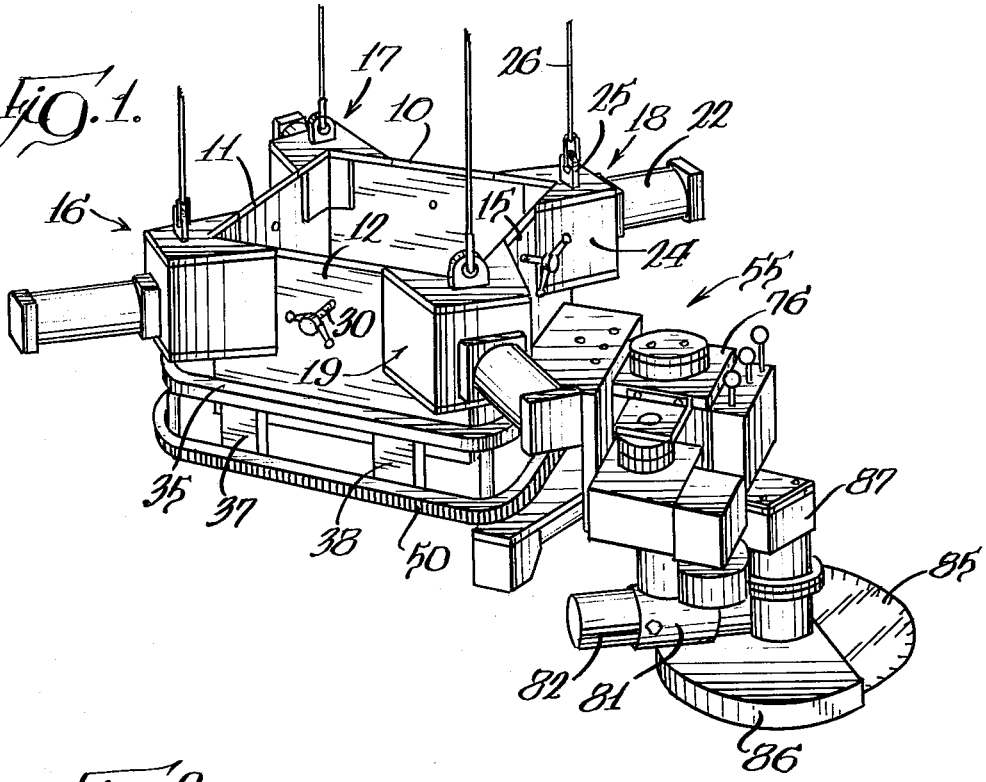
FIG. 1 is a perspective elevational view of the pile-cutting machine, looking toward a side thereof.
Figure 2:
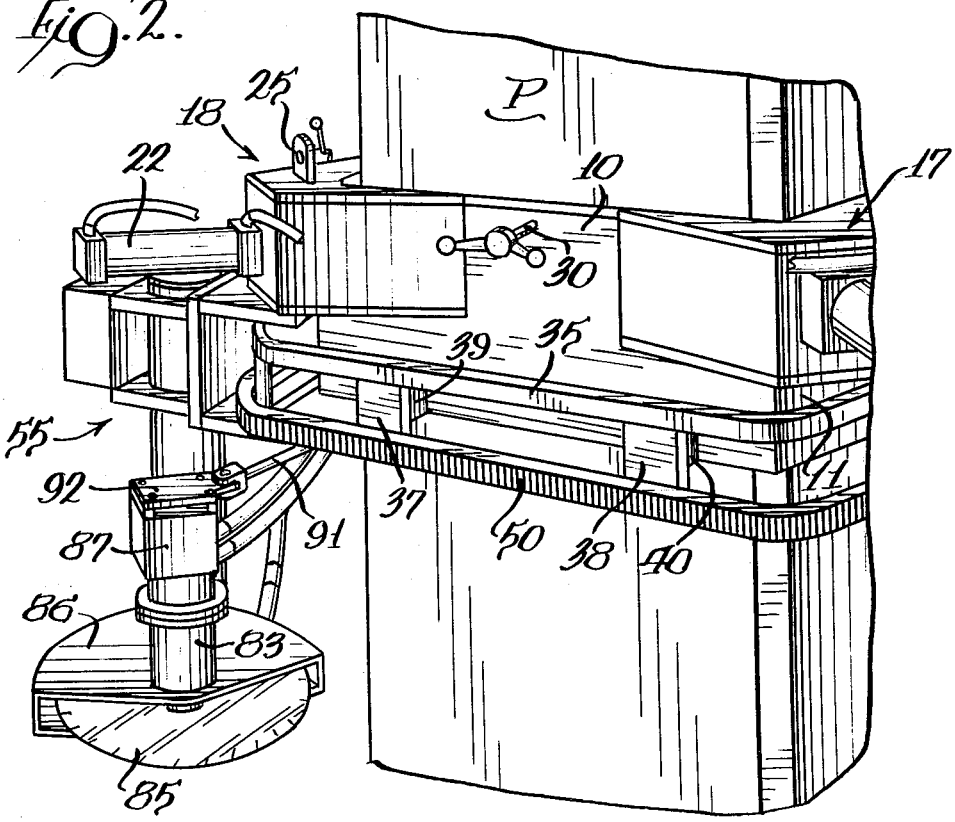
FIG. 2 is a perspective elevational view of the machine, looking toward another side thereof and showing the machine in association with a pile.
Figure 3:
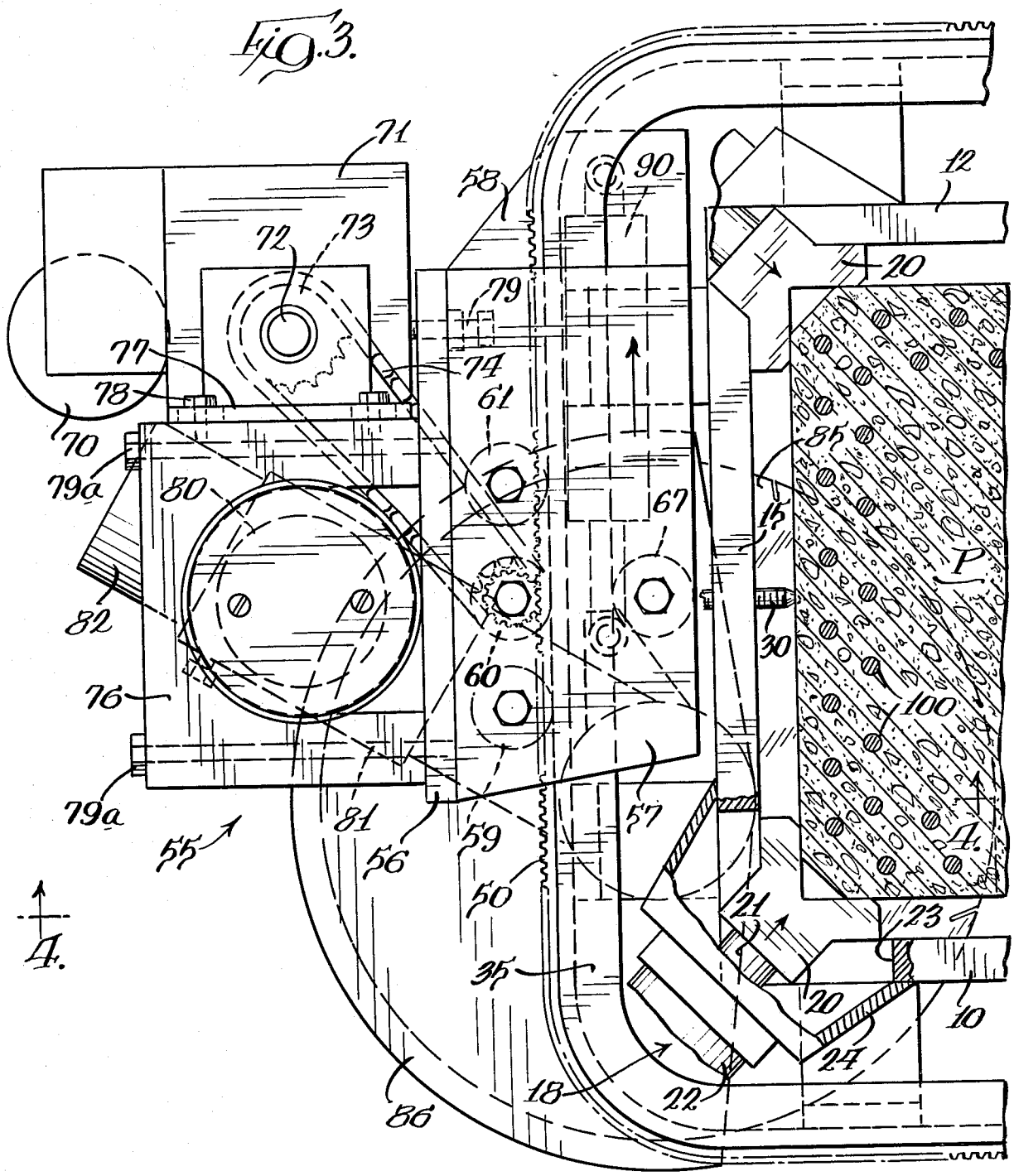
FIG. 3 is a fragmentary plan view of the machine with parts broken away and shown in association with a fragmentary part of a pile which is in cross section.

The pile-cutting machine is shown generally in FIGS. 1 and 2 and has a frame defining a generally square interior opening and comprising four verticallyextending plates 10, 11, 12 and 15 which are suitably secured together in end-to-end relation to define a frame with four corners which mounts a hydraulically-operable clamp at each corner. The hydraulically-operated clamps are indicated generally at 16–19. Each of the clamps includes a V-shaped clamp member 20, as shown for the clamp 18 in FIG. 3, which is connected to a piston rod 21 mounted in a cylinder 22 for movement between a retracted position and the advance position shown in FIG. 3 wherein the clamp member engages against a corner of a pile P. Movement of the clamp member is permitted by a suitable opening 23 formed at the corner of the frame plates, such as frame plates 10 and 15 shown in FIG. 3. The clamp member is enclosed within a housing 24 and with a top plate of the housing mounting an apertured bracket 25 to receive a lifting cable 26. As shown in FIG. 1, a lifting cable 26 can be attached to each of the clamp housings whereby the machine can be moved downwardly along the pile P, as shown in FIG. 2, to a desired location for making a cut in the pile at a level beneath the frame. When the frame is at the desired location, a hydraulic valve can be operated to advance the clamp members 20 and clamp the frame firmly against the pile. To guard against loss of hydraulic power, each of the frame walls has a manually rotatable threaded clamp member 30 which can be advanced into biting relation with the concrete pile, as shown in FIG. 3.

The frame has linear guide means mounted thereon shaped to define a square with rounded corners and intermediate straight sections. The guide means includes an upper guide member 35 and a lower guide member 36 in spaced vertical relation and which are mounted outwardly of the lower ends of the frame plates 10, 11, 12 and 15 and secured thereto by transverse mounting plates 39 and 40 as shown particularly for the guide track sections outwardly of the frame wall 10 and with there being similar structure extending outwardly from each of the other frame walls.

Figure 6:
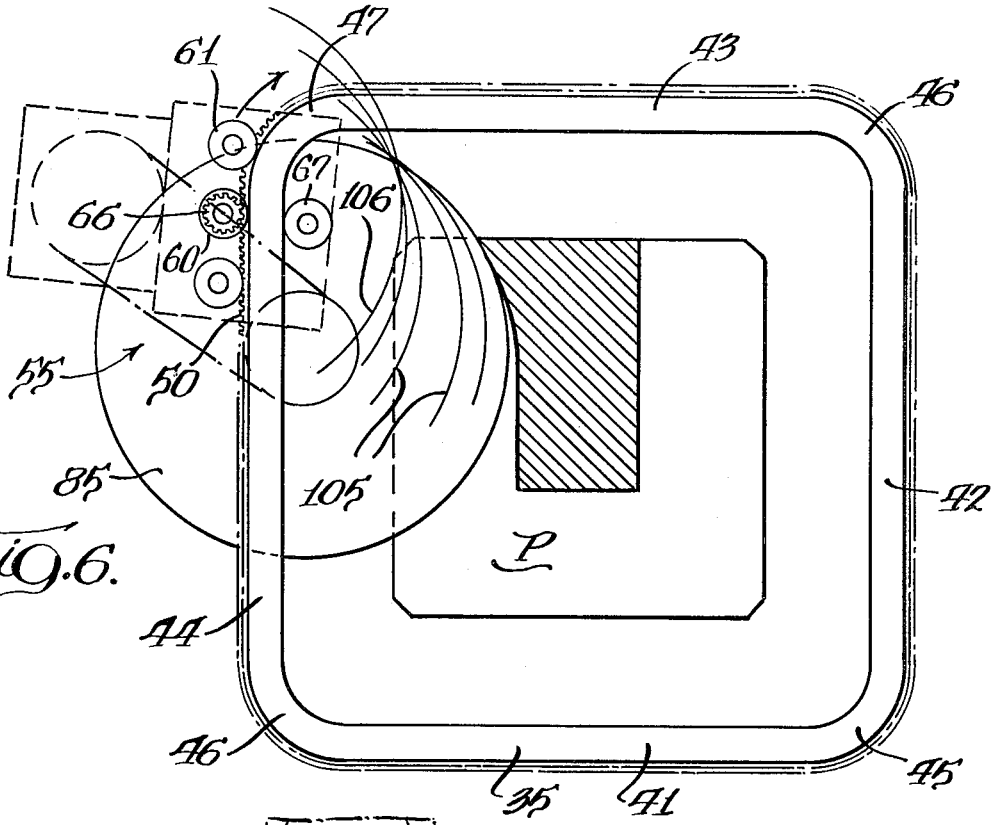
FIG. 6 is a diagrammatic view showing the action of the power-driven cutter as it approaches the end of its cut along the third side of the pile.
Figure 7:
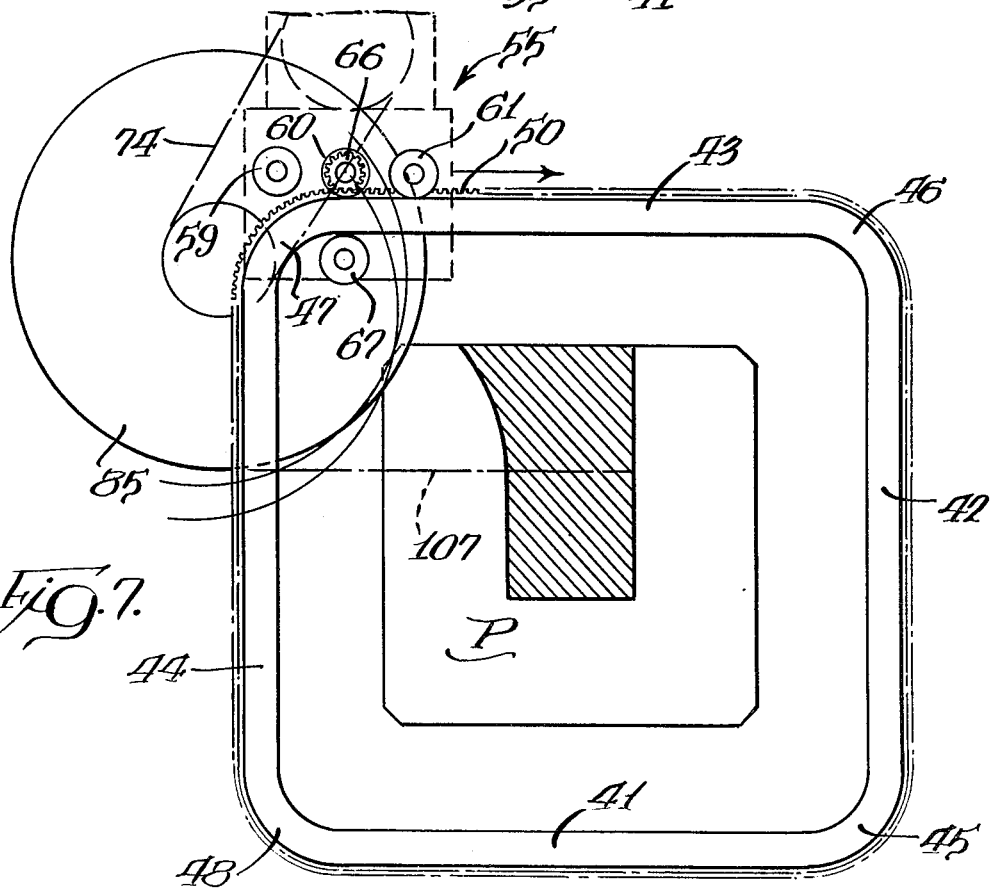
FIG. 7 is a view, similar to FIG. 6, showing the action of the cutter in withdrawing from the cut prior to advance thereof along the fourth side of the pile for cutting thereof.

Referring to the diagrammatic views of FIGS. 6 and 7, the guide means has the straight sections 41, 42, 43, and 44 with interconnecting rounded corners 45, 46, 47 and 48. A continuous gear track 50, having the same shape as the guide means, is secured to the lower guide member 36, as shown particularly in FIG. 4.

A carriage, indicated generally at 55, is mounted for movement along the guide means and has a base plate 56 with outwardly-extending upper and lower plates 57 and 58 suitably attached thereto and in spaced relation to mount guide rollers which coact with the guide means. The guide rollers include three upper guide rollers 59, 60, and 61 which coact with and engage the outer face of the upper guide member 35 and which are flanged at 62 to have the flange rest upon the upper surface of the guide member 35. A drive shaft 65 extends between the upper and lower plates 57 and 58 and mounts a driven gear 66 which meshes with the continuous gear track 50.

Figure 4:
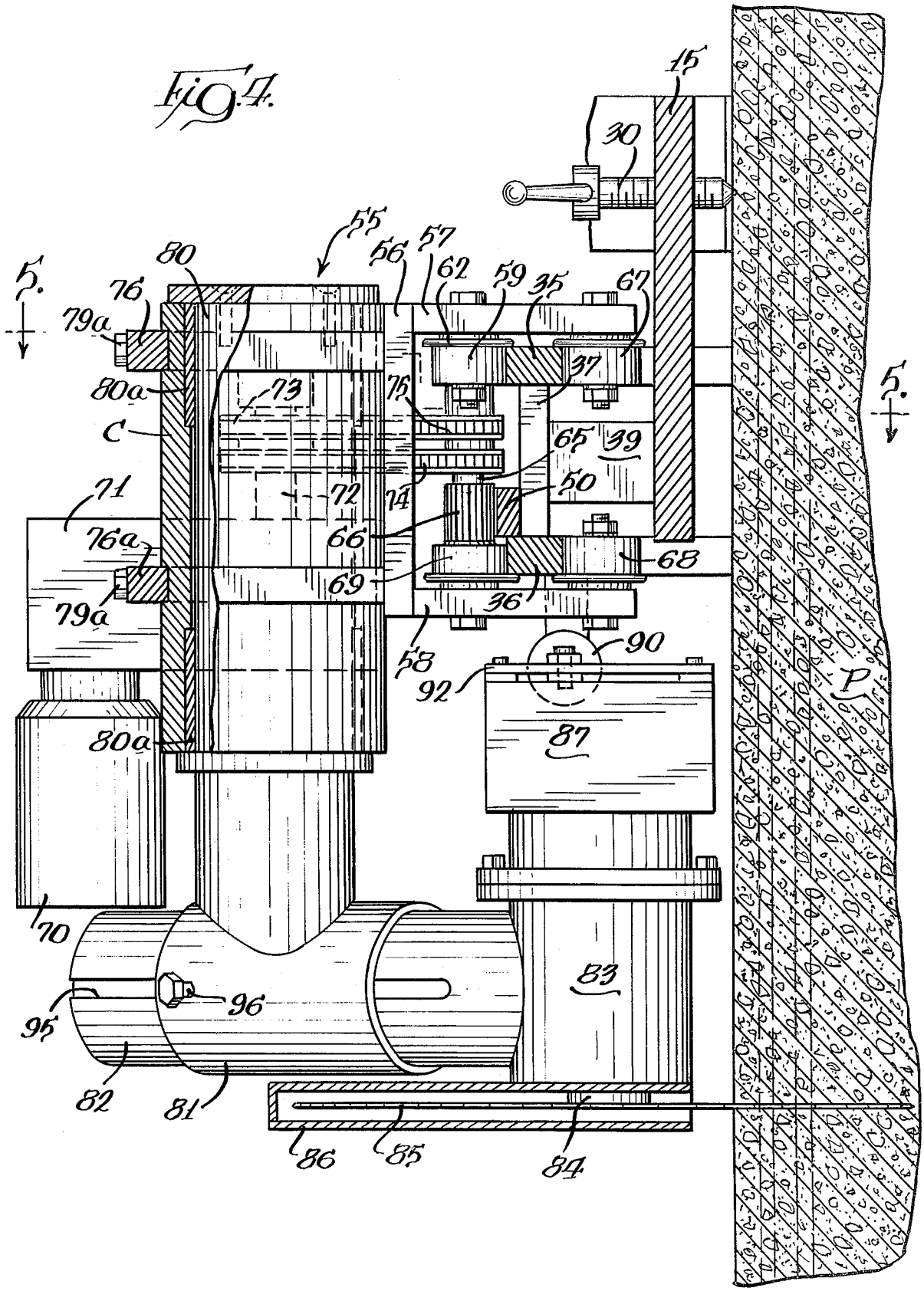
FIG. 4 is a vertical section, taken generally along the line 4—4 in FIG. 3 and with parts broken away.

An additional pair of vertically-aligned flanged guide rollers 67 and 68 coact with the inner surfaces of guide members 35 and 36 and are located directly opposite the driven gear 66. An additional guide roller 69 is coaxial with the driven gear 66 and engages the guide member 36. With this mounting of the carriage to the guide means, the carriage 55 is caused to travel along the straight sections of the guide means and to swing around a rounded corner thereof as the carriage 55 moves further in the direction indicated by the arrow in FIG. 6. The mounting plates 39 and 40 for the guide means are of relatively short height, as shown in FIG. 4, whereby they do not interfere with the inner guide rollers 67 and 68 during movement of the carriage along the guide means.

The carriage is propelled along the guide means by rotation of the driven gear 66. This drive is from a hydraulic motor 70 connected to a gear reduction unit 71 which has an output shaft 72 with sprockets 73 driving chains 74 which extend around sprockets 75 on the shaft 65 whereby rotation of the motor 70 causes rotation of the driven gear 66 at a desired rate of speed for advance of the carriage.

The motor 70 and gearbox 71 are adjustably mounted to a pair of clamps 76 and **76*a* mounted to the carriage base plate 56. The gear reduction unit has flanges 77 adjustably bolted to the clamps 76, 76*a* by bolts 78 and with there being adjustment screws 79 carried by the carriage base plate and abutting against the gearbox whereby loosening of the bolts 78 permits operation of the adjusting screws 79 to provide the desired tightness of the chains 74** and, thereafter, the bolts are tightened.

The clamps 76 and **76*a* hold a cylindrical casing C in fixed relation to the base plate 56 by clamp bolts 79*a*. The casing C rotatably mounts a member 80 for rotation about a vertical axis and within fixed bearings 80*a*. The member 80 has a plate 80*b* at the upper end coacting with the casing C for holding the member positioned within the casing and has a transverse cylinder 81 at its lower end which telescopically receives a tubular member 82. The tubular member 82 has a tubular right angle section 83 rotatably mounting a drive shaft 84 for a power-driven cutter in the form of a disc 85 partially enclosed by a guard 86. The cutter drive shaft 84 is driven by an hydraulic motor 87 mounted to the right angle section 83**.

The cutter can be advanced between the withdrawn position, shown in FIGS. 1 and 2, and the position of cutting depth, shown in FIGS. 3 and 4, by rotating the cutter mounting about the rotation axis of the member 80. This movement is by means of a pivotally fixed hydraulic cylinder 90 having a piston rod 91 connected to a plate 92 secured to the upper end of the motor 87. The depth of cut within the pile P by the cutter 85 can be adjusted by adjusting the lengthwise relation of the transverse cylinder 81 and tubular member 82. For this purpose, the tubular member 82 has a pair of grooves on opposite sides thereof, with one being shown at 95 and with there being a pair of locking screws threaded into the transverse cylinder 81 and associated one with each groove. The locking screw 96 associated with the groove 95 is shown in FIG. 4. This adjustment changes the effective length of the arm defined by tubular member 82, which is the mounting arm for the cutter 85.

Figure 5:
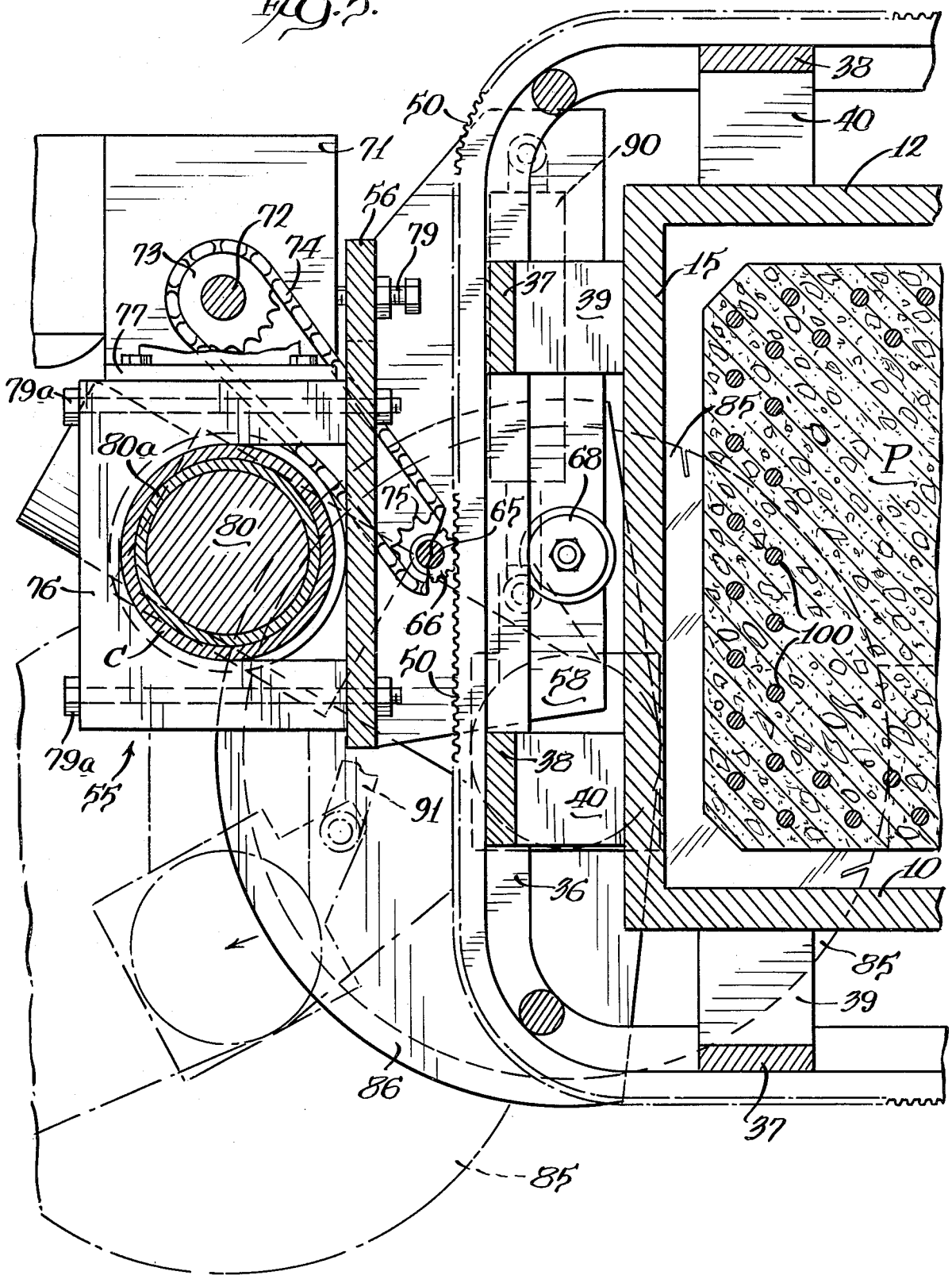
FIG. 5 is a plan section, taken generally along the line 5—5 in FIG. 4 showing the cutter in full line at cutting depth and in a broken line withdrawn position.

In operation, the machine, with the clamps 22 and 30 withdrawn, is lowered into position in association with the pile P by means of cables 26 to a desired location and then the clamps are operated to firmly hold the machine in place, as shown in FIG. 2. The motor 87 is energized to rotate the cutter 85, with the carriage 55 positioned at an end of a straight section of the guide means. The cylinder 90 is then actuated to advance the cutter to the cutting depth, as shown in FIG. 3 and FIG. 5, which positions the cutter to cut the concrete and a series of reinforcing rods 100 which are imbedded within the pile. The motor 70 is then operated to rotate the drive gear 66 to cause advance of the cutter along one straight side of the pile. Referring to FIG. 6, there have been two passes of the cutter along two sides of the pile and the cutter 85 is shown near completion of the cut along a third side of the pile. As the carriage 55 goes around the rounded corner 47, the carriage automatically swings, with the result that the cutter 85 automatically moves outwardly away from the pile, progressively as shown by a series of lines generally indicated at 105 in FIG. 6, until the cutter is in the position indicated by a line 106 and is completely clear of the pile. As the carriage swings into alignment with the straight section 43 of the guide means, there are no destructive binding forces on the cutter 85 which would occur if the cutter remained within the cut in the pile. The position preparatory to making the final cut is shown in FIG. 7 wherein the cutter 85 is free of the pile and, as the carriage 55 advances in the direction of the arrow, the final cut is made by the edge of the cutter moving along the broken line 107. This leaves a relatively small square core section of the pile which is free of reinforcing rods and which can be snapped off by lifting of the machine which is still clamped to the section of the pile above the cut.

With the machine disclosed herein, it will be seen that a multi-sided pile can be cut with a single pass of a cutter therearound. More specifically, in the square pile shown, the cutter makes four cuts along the four sides of the pile in a single pass. The cutter is automatically withdrawn at the corners because of the trailing relation thereof to the carriage 55 which avoids any binding on the cutter within the pile as the corner is turned.

The cutting location of the cutter 55 relative to the carriage and guide means can be adjusted by adjusting the relation between the transverse cylinder 81 and the tubular member 82 whereby the desired depth of cut with respect to any particular size pile may be obtained.

From the foregoing, it will be seen that a multi-sided pile may be cut in a single pass around the pile by a method utilizing a rotatable cutter and by the steps of rotating the cutter at the cutting speed, feeding the cutter into the pile to the cutting depth, advancing the cutter along the side of the pile to form a length of cut in the pile, positioning the cutter for advance along the next side of the pile while simultaneously withdrawing the cutter from the preceding length of cut and repeating said positioning and withdrawal until all sides of the pile are cut.

We claim:

1. A multi-sided pile-cutting machine comprising, a frame positionable at a desired location along the length of a multi-sided pile and having clamp means engageable with the pile for holding the frame at said location, a carriage mounted on the frame for movement in a continuous path around said pile, a cutting head carried by the carriage with a power-driven cutter positioned relative to the carriage to be at full cutting depth in a pile as the carriage moves along a straight side of the pile, and means for withdrawing the cutter from the pile as the carriage travels around a corner of the pile and thereafter causing the cutter to be at full cutting depth in the pile with continued advance of the carriage along succeeding straight sections of the pile.

2. A multi-sided pile-cutting machine comprising, a frame positionable at a desired location along the length of a multi-sided pile and having clamp means engageable with the pile for holding the frame at said location, guide means and a gear track mounted on said frame and shaped to define a square with rounded corners and intermediate straight sections, a carriage mounted for movement along said guide means by guide members engageable with the guide means and which cause the carriage to swing relative to the frame at said rounded corners, a cutting head carried by the carriage with a power-driven cutter positioned relative to the carriage to be at full cutting depth in a pile as the carriage moves along a straight section of the guide means, to automatically withdraw from the pile as the carriage swings in travelling around a rounded corner of the guide means and thereafter again move to full cutting depth in the pile with continued advance of the carriage along a straight section of the guide means, and a driven gear on said carriage engageable with said gear track for advancing said carriage along said guide means.

3. A multi-sided pile-cutting machine comprising, a frame positionable at a desired location along the length of a multi-sided pile and having clamp means engageable with the pile for holding the frame at said location, guide means mounted on said frame and shaped to define a square with rounded corners and intermediate straight sections, a carriage mounted for movement along said guide means by guide members engageable with the guide means and which cause the carriage to swing relative to the frame at said rounded corners, and a cutting head carried by the carriage with a power-driven cutter positioned relative to the carriage to be at full cutting depth in a pile as the carriage moves along a straight section of the guide means, to automatically withdraw from the pile as the carriage swings in travelling around a rounded corner of the guide means and thereafter again move to full cutting depth in the pile with continued advance of the carriage along a straight section of the guide means.

4. A pile-cutting machine as defined in claim 3 wherein said power-driven cutter is carried on an arm fixed to and extending from said carriage at an angle to place said cutter in trailing relation to said carriage whereby said arm swings away from the pile as the carriage swings at a corner of the guide means.

5. A pile-cutting machine as defined in claim 4 wherein said arm is formed of two interfitting relatively adjustable parts for adjustment in the length thereof, and means for locking said parts together.

6. A cutting machine as defined in claim 4 wherein said arm is pivotally mounted on said carriage, and means for pivoting said arm between a retracted inactive position and an operative position at said angle to the carriage.

7. A cutting machine as defined in claim 6 wherein said pivoting means is a piston and cylinder connected between said carriage and said arm.

8. A cutting machine as defined in claim 3 wherein said frame mounts a continuous gear track having the same general shape as said guide means, and a driven gear on said carriage in mesh with said gear track for propelling the carriage along the guide means.

9. A cutting machine as defined in claim 3 including a set of hydraulically operated pile clamps on said frame above said guide means, and a set of manually operated pile clamps on said frame intermediate the hydraulically operated pile clamp.

10. A cutting machine for cutting a multi-sided pile comprising, a frame positionable at a desired location along the length of and surrounding the pile and having clamp means engageable with the pile for holding the frame at said location, guide means mounted on said frame and contoured to the shape of the pile with rounded corners and intermediate straight sections, a carriage mounted for movement along said guide means by guide members engageable with the guide means and which cause the carriage to swing relative to the frame at said rounded corners, and a cutting head carried by the carriage with a power-driven cutter positioned relative to the carriage to be at full cutting depth in a pile as the carriage moves along a straight section of the guide means, to automatically withdraw from the pile as the carriage swings in travelling around a rounded corner of the guide means and thereafter again move to full cutting depth in the pile with continued advance of the carriage along a straight section of the guide means.

11. A pile-cutting machine as defined in claim 10 wherein said power-driven cutter is carried on an arm fixed to and extending from said carriage at an angle to place said cutter in trailing relation to said carriage whereby said arm swings away from the pile as the carriage swings at a corner of the guide means.

12. A pile-cutting machine as defined in claim 11 wherein said arm is formed of two interfitting relatively adjustable parts for adjustment in the length thereof, and means for locking said parts together.

13. A cutting machine as defined in claim 11 wherein said arm is pivotally mounted on said carriage, and means for pivoting said arm between a retracted inactive position and an operative position at said angle to the carriage.

14. A cutting machine as defined in claim 10 wherein said frame mounts a continuous gear track having the same general shape as said guide means, and a driven gear on said carriage in mesh with said gear track for propelling the carriage along the guide means.

15. The method of cutting a multi-sided pile by a rotatable cutter in a single pass of the cutter around the pile by guiding the cutter in a continuous closed path of travel around successive sides of the pile, comprising, rotating the cutter at a cutting speed, feeding the cutter into the pile to a cutting depth, advancing the cutter along a side of the pile to form a straight length of cut in said pile, positioning the cutter as the cutter continues to move in the continuous closed path for advance along the next side of the pile while simultaneously withdrawing the cutter from the preceding length of cut, and repeating said positioning and withdrawal until all sides of the pile are cut and the cutter has travelled a complete circuit in said continuous closed path.

16. The method as defined in claim 15 wherein said cutter is mounted on a carriage for said advancing movement and positioned in a trailing relation thereto, and the additional step of swinging the carriage around a corner of the pile to cause an outward swing of the cutter for said withdrawal thereof.

* * * * *